US005636400A

United States Patent [19]

Young

[11] Patent Number: 5,636,400

[45] Date of Patent: Jun. 10, 1997

[54] AUTOMATIC INFANT BOTTLE CLEANER

[76] Inventor: Keenan L. Young, 628 Jackson St., Owensboro, Ky. 42303

[21] Appl. No.: 512,159

[22] Filed: Aug. 7, 1995

[51] Int. Cl.[6] ..... A46B 13/02

[52] U.S. Cl. ..... 15/23; 15/59; 15/65

[58] Field of Search ..... 15/23, 22.1, 88, 15/104.03, 104.04, 104.05, 104.095, 97.1, 59, 65, 67, 68, 71, 88.3, 104.9, 207.2; 134/8

[56] References Cited

U.S. PATENT DOCUMENTS

| | | | |
|---|---|---|---|
| 602,190 | 4/1898 | Evans | 15/65 |
| 2,241,464 | 5/1941 | Koch | 15/23 |
| 2,626,413 | 1/1953 | Girton | 15/104.9 |
| 3,187,361 | 6/1965 | Wheeler | 15/23 |
| 3,407,431 | 10/1968 | Melnik | 15/23 |
| 3,982,297 | 9/1976 | Belluomo | 15/23 |
| 4,137,588 | 2/1979 | Sandt et al. | 15/23 |
| 4,479,516 | 10/1984 | Hunter | 15/22.1 |
| 4,701,973 | 10/1987 | McBrady et al. | 15/88 |
| 4,751,452 | 6/1988 | Kilmer et al. . | |
| 4,835,410 | 5/1989 | Bhagwat et al. . | |
| 4,845,796 | 7/1989 | Mosley | 15/23 |
| 5,089,738 | 2/1992 | Bergqvist et al. . | |
| 5,185,938 | 2/1993 | Hutt . | |
| 5,224,231 | 7/1993 | Nacar . | |
| 5,307,534 | 5/1994 | Miller . | |
| 5,311,632 | 5/1994 | Center | 15/22.1 |
| 5,353,461 | 10/1994 | Enriguez | 15/23 |
| 5,423,102 | 6/1995 | Madison | 15/22.1 |
| 5,450,646 | 9/1995 | McHugh et al. | 15/23 |

FOREIGN PATENT DOCUMENTS

| | | |
|---|---|---|
| 23 65 579 | 10/1975 | Germany . |
| 27 33 432 | 4/1979 | Germany . |

*Primary Examiner*—David Scherbel
*Assistant Examiner*—James F. Hook
*Attorney, Agent, or Firm*—Richard C. Litman

[57] ABSTRACT

An automatic infant bottle cleaner comprises a hand-held, battery-operated drill mechanism having a bristle brush attachment. The drill mechanism has an ergonomically angled case made of hard plastic. The drill mechanism also has a three position slide switch, a rectifier, two rechargeable batteries, and a small three volt DC motor. A method of using the cleaner is also provided.

7 Claims, 2 Drawing Sheets

AUTOMATIC INFANT BOTTLE CLEANER

BACKGROUND OF THE INVENTION

1. Field of the Invention

The present invention relates generally to cleansing implements, and more particularly to cleaners for baby bottles.

2. Description of the Prior Art

As almost every parent knows, cleaning babies' bottles is a tedious and time-consuming problem. With all the other chores a parent of an infant must attend to, cleaning babies' bottles can become a serious nuisance. For this reason, it is desirable to have a quick, easy way to clean babies' bottles. Prior to the present invention, however, no device has been seen that provides the comfortable, speedy cleaning of babies' bottles that the present invention provides.

U.S. Pat. No. 4,751,452, issued to Paul R. Kilmer et al., on Jun. 14, 1988, shows a hand held battery powered drill with a bit-retaining section for wire wrapping attachments. There is no showing of a brush attachment.

U.S. Pat. No. 4,835,410, issued to Pradeep M. Bhagwat et al., on May 30, 1989, shows a power system for selectively corded and cordless electrically powered devices. There is no brush attachment shown.

U.S. Pat. No. 5,089,738, issued to Hakan Bergqvist et al., on Feb. 18, 1992, shows a battery-driven power tool having a preferred, adjustable center of gravity. There is no brush attachment shown.

U.S. Pat. No. 5,185,938, issued to Heinz Hutt, on Feb. 16, 1993, shows a paint brush and roller cleaner for attachment to a chuck of a drill. There is no provision of an ergonomic handle angle.

U.S. Pat. No. 5,224,231, issued to Ernesto Nacar, on Jul. 6, 1993, shows a brush attachment for an electric drill. There is no provision for multiple brush speeds.

U.S. Pat. No. 5,307,534, issued to Richard P. Miller, on May 3, 1994, shows a drill attachment which is used to clean the interior of a pipe. There is no provision of an ergonomic handle angle.

German Patent Document No. 23 65 579, issued to Mabuchi Motor Co., on Oct. 30, 1975, shows a portable power tool having internal batteries. There is no brush attachment shown.

German Patent Document No. 27 33 432, issued to Erich Dieter Walkenhorst, on Apr. 19, 1979, shows an attachment for flashlights that can be used to rotate brushes. There is no provision of an ergonomically angled handle.

None of the above inventions and patents, taken either singly or in combination, provides an angled brush cleaner device, and none is seen to describe the instant invention as claimed.

SUMMARY OF THE INVENTION

An automatic infant bottle cleaner, according to the present invention, comprises a hand-held, battery-operated drill mechanism and a bristle brush attachment. The drill mechanism has a housing that is preferably made of hard, durable plastic, and includes two connected portions that are angled relative to one another. The drill mechanism also has a three position slide switch, a rectifier, and a small three volt DC motor. A method of using the cleaner includes steps of activating the drill mechanism, moving the cleaner's brush attachment up and down inner sides of a baby bottle, and moving the cleaner's brush attachment circularly around inner sides of a baby bottle.

Accordingly, it is a principal object of the invention to provide an ergonomically configured device for cleaning baby bottles.

It is another object of the invention to avoid shortcomings associated with manual scrubbing devices.

It is a further object of the invention to provide an effective method for using an electronic baby bottle cleaner.

Still another object of the invention is to maintain a power reserve in a baby bottle cleaner so that a baby bottle cleaner can be used electronically even apart from a utility company's electric supply.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention provides an automatic infant bottle cleaner that is easy and effective to use. An ergonomic casing provides advantageous angling of the cleaner in a user's hand, thereby facilitating cleaning of infant bottles. Convenient power handling capability allows use of the cleaner via an internal direct current supply.

Figure 1:
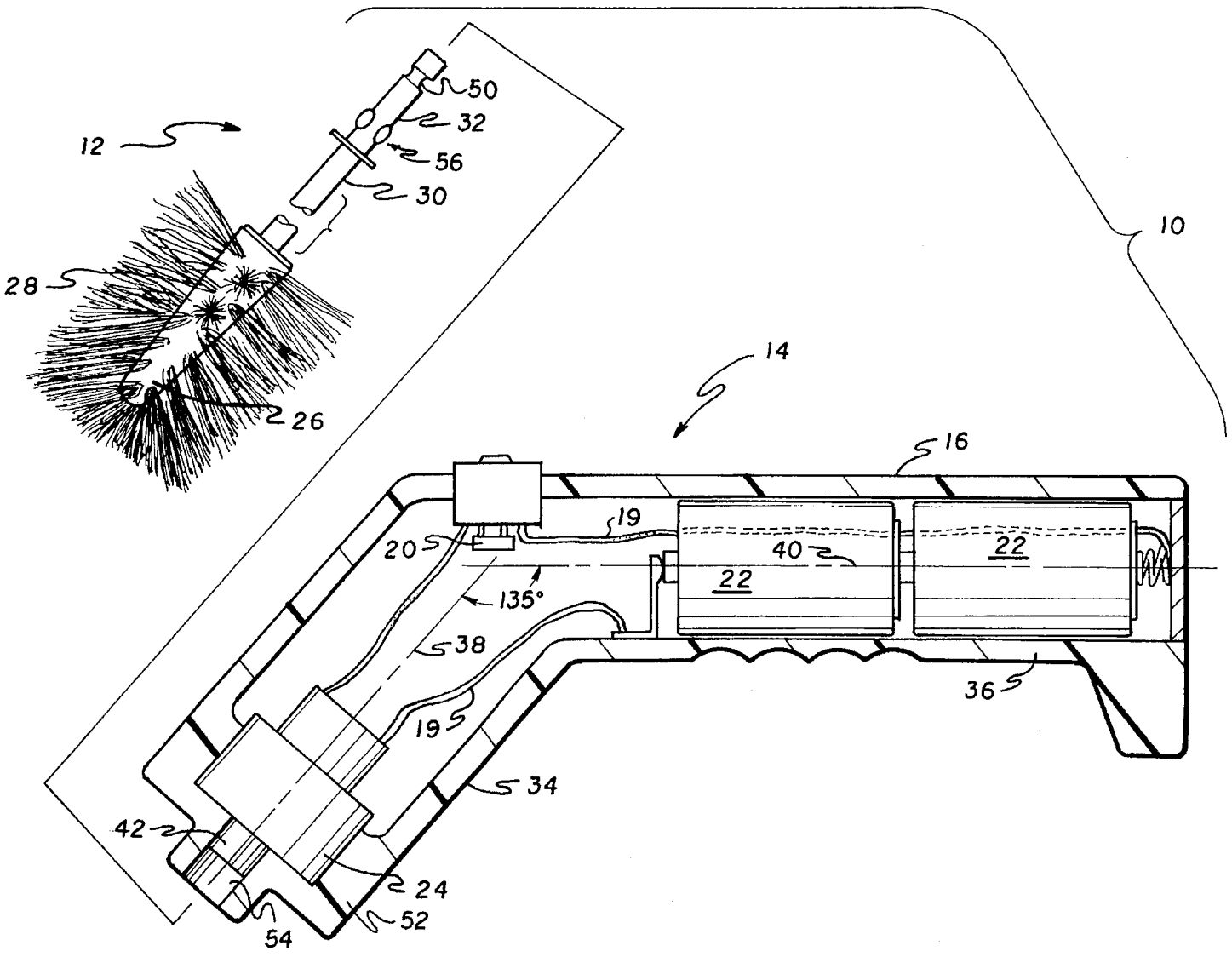
FIG. 1 is an environmental, cutaway, partially exploded, perspective view of the present invention when being used to clean a baby bottle.

Referring to the drawings, an automatic infant bottle cleaner 10 according to the present invention comprises a brush attachment 12, and a drill mechanism 14 having a unitary driver case 16, a switch 18, a rectifier 20, a power supply 22 and a motor 24. The brush attachment 12 has a rounded conical head 26 with a plurality of bristles 28 projecting therefrom. Importantly, the shape of the head 26 aids in reaching corners of baby bottles for cleaning, yet all bristles 28 preferably extend in such a way as to create an outline of a truncated cylinder, as shown in FIG. 1. A rod-shaped member 30 connects the head 26 to a connector region 32 that is dimensioned and configured as by groove 50 and protrusions 56; to releasably attach the brush attachment 12 to the drill mechanism 14 in such a way that the brush attachment 12 mechanically engages the motor 24. Because of this engagement, turning of the motor 24 brings about equal turning of the brush attachment 12.

The driver case 16 has a front portion 34 and a rear portion 36. The front portion 34 has walls defining a centrally disposed holder 52 and a receiving channel 54 concentrically protruding from the holder 52. The front portion 34 and the rear portion 36 each having a long axis 38, 40, the long axis 38 of the front portion 34 having an angle of between one-hundred-twenty and one-hundred-fifty, preferably one-hundred-thirty-five, degrees relative to the long axis 40 of the rear portion 36. Preferably, the angle is one-hundred-thirty-five degrees. This preferred angle allows for easy application of pressure via the brush attachment 12 to an infant bottle, while simultaneously allowing easy manipulation of the cleaner 10. The driver case 16 is reversibly openable by known means. Opening of the driver case 16 allows removal and replacement of contents of the driver case 16, whereupon the driver case 16 is put back into a closed configuration.

The motor 24 is fixedly disposed within the holder 42 in the driver case 16. The motor 24 has a means 42 for attaching the brush attachment 12 to the motor 24, the means 42 being contained within the front portion 34 of the driver case 16. Activation of the motor 24 brings about rotation of the brush attachment 12. Preferably, the motor 24 is a conventional three-volt, direct-current electric motor that operates at or around six thousand revolutions per minute, although other known motors could be used.

Figure 2:
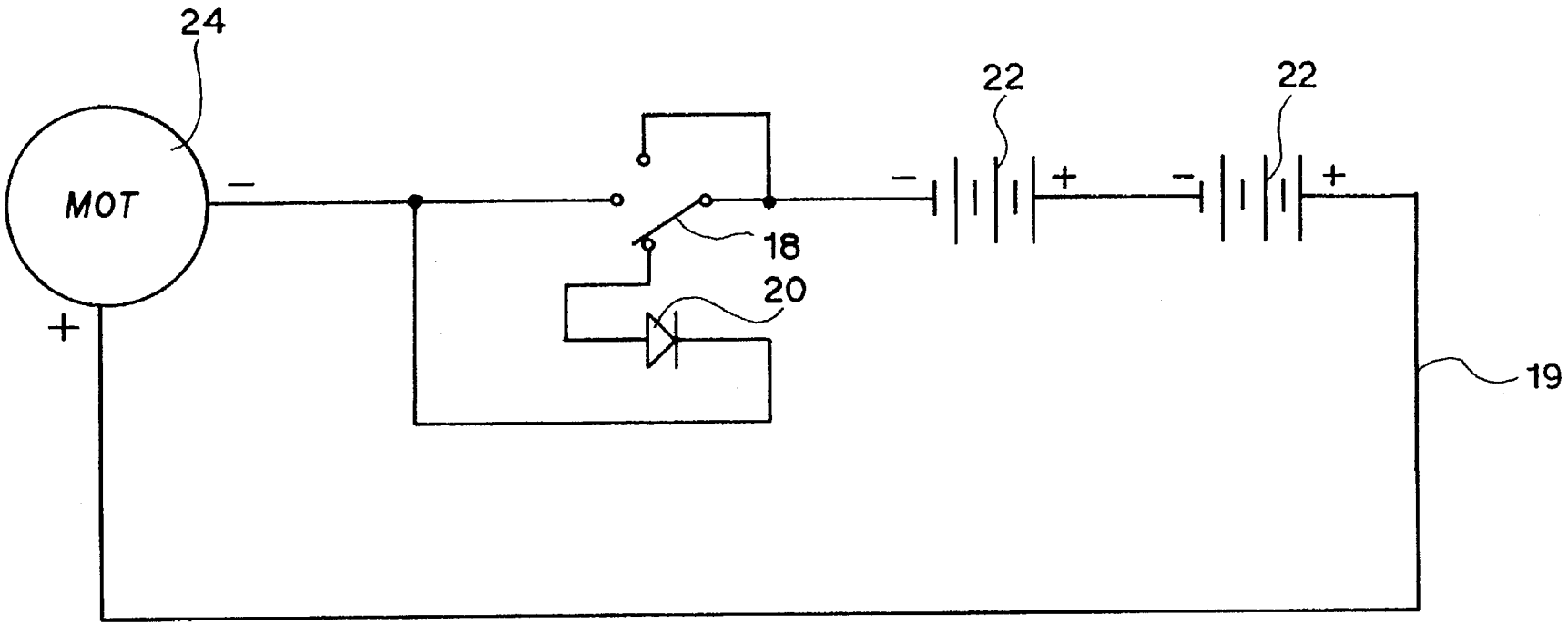
FIG. 2 is a circuit diagram of an electronic circuit used in the present invention.

Also in the driver case 16 are the rectifier 20, the power supply 22, which includes at least one battery 22, and the switch 18. The switch 18 selectively completes one of three circuits, shown schematically in FIG. 2 with a "low-on" circuit completed. The rectifier 20 is preferably a diode of the type NTE5814 (VF equals 0.9 V), although other rectifiers can be used. The rectifier 20 serves to selectively reduce voltage supplied from the power supply 22 to the motor 24, as described below. The power supply 22 is preferably a pair of conventional 1.5 volt nickel-cadmium batteries, although other known power supplies could be used, as appropriate for supplying power to the motor 24.

The switch 18 is preferably a conventional three-position slide switch 18 rated at 125 VAC, 3 A, although other known switches could be used. The switch 18 is selectively configured by a user to complete one of three circuits, elements of which are connected by conventional electrical wire 19. A first circuit, when selectively completed by the switch 18, puts the drill mechanism 14 in an "off" condition. That is, the power supply 22 is electrically isolated from the motor 24 and rectifier 18, the switch 18 being the lone element in this first circuit.

A second circuit selectively completed by the switch 18 puts the drill mechanism 14 in a "low-on" condition, i.e. the motor 24 and brush attachment 12 turn at a low speed, as compared to a maximum possible speed. In this circuit, the rectifier 18, the power supply 22, and the motor 24 are connected in series, via the switch 18.

A third circuit selectively completed by the switch 18 puts the drill mechanism 14 in a "high-on" condition, i.e. the motor 24 and brush attachment 12 turn at a high speed, as compared to the "low-on" condition. In this circuit, the power supply 22 and the motor 24 are connected in series, via the switch 18, without the rectifier 18 participating in the circuit.

A method of using the cleaner 10 includes steps of activating the drill mechanism 14, moving the cleaner's brush attachment 12 up and down inner sides of a baby bottle (not shown), and moving the cleaner's brush attachment 12 circularly around inner sides of the baby bottle. The up-and-down movement and circular movements are then repeated sequentially until the bottle is cleaned to a predetermined degree.

It is to be understood that the present invention is not limited to the sole embodiment described above, but encompasses any and all embodiments within the scope of the following claims.

I claim:

1. An automatic infant bottle cleaner, comprising:

a unitary cylindrical driver case having a front portion and a rear portion, said front portion fixedly connected to said rear portion at a bend in said driver case, said front portion having a first axis and said rear portion having a second axis, said first axis and said second axis defining an angle between 120 and 150 degrees, said front portion having walls defining a centrally disposed holder and a receiving channel concentrically protruding from said holder at an end of said front portion;

a motor fixedly disposed within said holder, said motor having an attachment mechanism protruding from said motor;

a switch disposed in said driver case proximate said bend, said switch including three selectable positions for selectively energizing said motor;

a rectifier disposed in said driver case proximate said switch;

a power supply disposed in said rear portion; and a brush attachment having an elongated rod, a cylindrical connector, and a rounded conical head for reaching corners of an infant bottle, said rod having a length sufficient to reach bottom sections of an infant bottle, said rod integrally connecting said connector to said conical head, said connector having a groove for mechanically engaging said brush attachment to said motor, said connector being releasably attachable to said attachment mechanism, said conical head having a plurality of bristles projecting therefrom, said plurality of bristles covering said conical head to form a cylinder, whereby a user may select a switch position to activate rotation of said brush attachment for easy and efficient cleaning of an infant bottle.

2. The automatic infant bottle cleaner according to claim 1 wherein said switch, said rectifier, said motor and said power supply are connected in series when said switch is configured in a first position;

said switch, said motor and said power supply are connected in series when said switch is configured in a second position; and said switch is a lone circuit element when said switch is configured in a third position.

3. The automatic infant bottle cleaner according to claim 2, wherein said power supply includes at least one battery.

4. The automatic infant bottle cleaner according to claim 3, wherein said at least one battery is at least one nickel-cadmium battery.

5. The automatic infant bottle cleaner according to claim 1, wherein said angle is 135 degrees for applying pressure via said brush attachment to an infant bottle, while simultaneously allowing easy manipulation of said cleaner.

6. The automatic infant bottle cleaner according to claim 5, wherein said rear portion has an ergonomically designed grip.

7. The automatic infant bottle cleaner according to claim 6, wherein said switch is located opposite said grip.

* * * * *